United States Patent [19]

Boyd

[11] Patent Number: 4,934,120

[45] Date of Patent: Jun. 19, 1990

[54] LAP JOINT ROOF ASSEMBLY

[75] Inventor: Thomas J. Boyd, Wellsburg, W. Va.

[73] Assignee: The Louis Berkman Company, Steubenville, Ohio

[21] Appl. No.: 386,209

[22] Filed: Jul. 28, 1989

[51] Int. Cl.[5] ..... E04D 1/00

[52] U.S. Cl. ..... 52/518; 52/521; 52/536; 52/555; 52/545

[58] Field of Search ..... 52/460, 462, 467, 528, 52/529, 537, 541, 536, 538, 542, 555, 521, 545, 547, 548

[56] References Cited

U.S. PATENT DOCUMENTS

| | | | |
|---|---|---|---|
| 2,250,764 | 7/1941 | Hoess | 52/536 X |
| 3,289,365 | 12/1966 | McLaughlin et al. | 52/521 X |
| 3,353,319 | 11/1967 | Gronlund | 52/520 |
| 3,852,933 | 12/1974 | Guzzo | 52/537 X |
| 3,945,166 | 3/1976 | Hosoda et al. | 52/525 X |
| 3,999,348 | 12/1976 | Hicks | 52/545 X |
| 4,096,681 | 6/1978 | Netterstedt et al. | 52/713 |

*Primary Examiner*—Carl D. Friedman
*Assistant Examiner*—L. R. Hoffert
*Attorney, Agent, or Firm*—Body, Vickers & Daniels

[57] ABSTRACT

A lap joint structure for adjoining panels of a sheet metal roofing assembly permits shifting of the joint panels longitudinally and transversely with respect to the joint as caused by thermally induced expansion and contraction, as well as providing a securely anchored connection of the panels to the roof substrate. Two adjacent panels are rigidly connected to one another, an underlying cleat is rigidly connected to the roof substrate, and the two joined panels are securely connected to the cleat with clearance allowed for thermally induced movements of the panels across the substrate.

42 Claims, 4 Drawing Sheets

FIG. 2A

FIG. 5
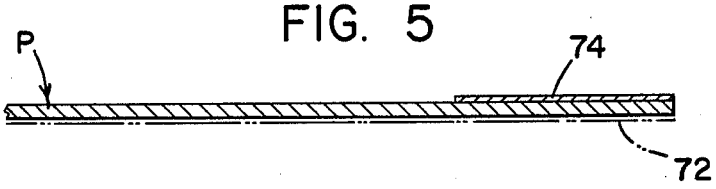
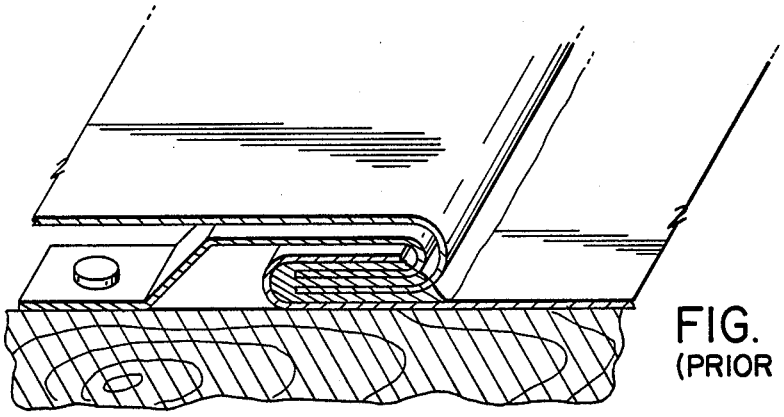
FIG. 6
(PRIOR ART)
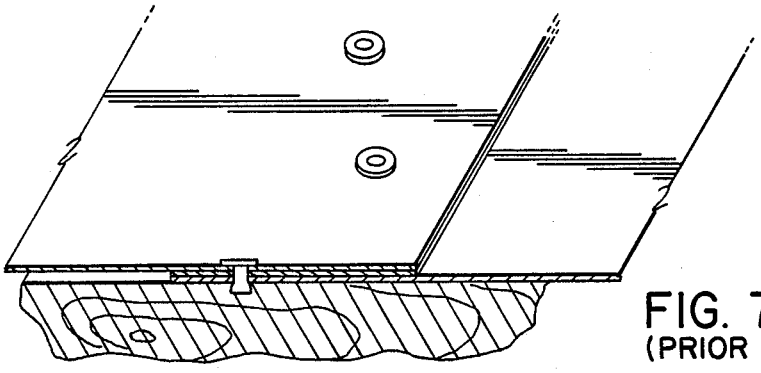
FIG. 7
(PRIOR ART)

LAP JOINT ROOF ASSEMBLY

The present invention pertains to the art of sheet metal roofing assemblies, and particularly to the structure of a lap joint between adjoining sheet metal roofing panels.

BACKGROUND OF THE INVENTION

Sheet metal panels are commonly used as components of commercial roofing structures. An assembly of sheet metal panels is fastened together to form a generally flat cover over a roof substrate which may comprise a framework of wood or metal joists, a plywood surface supported on an underlying framework of joists, poured concrete, or the like. Various types of joints are used to fasten the panels into a strong and watertight cover assembly. Standing seam joints comprise a folded connection between adjacent panels which extends vertically upwardly from the panels along the length of the joint. A novel standing seam joint structure is the subject of another patent application of the present inventor. This application pertains to a lap joint which has a primarily horizontal configuration across the joined panels.

A common lap joint structure is that used to assemble the traditional flat lock roof. A flat lock roof panel has edge sections folded back over the main section of the panel to form hemmed edges. The hems are left slightly open to permit hooked engagement with the oppositely facing hem of an adjacent panel to form a joint defined by the overlapping hem sections. The joints are soldered to provide a watertight seal. Although used consistently for many years, this type of joint structure has several problems. For example, the engaged hem sections, when considered in cross section, comprise four layers of sheet metal material which must be thoroughly heated from above to create conditions wherein the molten solder will be drawn into the joint sufficiently to provide a reliable watertight seal. The soldering portion of the assembly process is thus time consuming and skillfully demanding. Soldering problems also arise where the sheet metal panels are nailed or otherwise fastened to the underlying substrate since those punctures through the sheet metal material must be sealed against water. Furthermore, sealing the joints with solder results in a rigid connection between adjoining panels which cannot yield to the strenuous forces induced by thermal expansion and contraction and which may in turn cause buckling of the sheet metal material or breakage of the soldered seal.

Another disadvantage of the traditional flat lock roof joint structure is the difficulty of assembling the panels in an orderly layout along planned lines without accumulating substantial deviations between successively joined edges. This problem is best overcome by assembling a staggered array of panels having a practical size limit of 20×28 inches. As the number of joints multiplies with the number of panels, construction of a flat lock roof of any substantial size can become a disproportionately demanding portion of a commercial construction project.

Another type of lap joint structure for a sheet metal roofing assembly may be referred to as a flat lock joint with cleats. Such a joint comprises a row of cleats extending along the length of the joint. The cleats are each nailed or otherwise securely anchored to the roof substrate and include cleat hems interposed between the interlocking hem sections of the sheet metal panels to hold the panels down against the roof substrate. Since the panels are not nailed directly to the underlying substrate but instead are anchored thereto by means of the cleat, this joint structure is superior to the above-described flat lock joint structure which is prone to leak where the anchoring nails perforate the sheet metal panels. However, the overlapping hem sections must still be soldered, and positioning of the cleat hems between the interlocking panel hems brings the number of sheet metal layers which must be thoroughly heated to a total of six. The skill, time, and consequent cost of providing a water tight soldered seal along the entire length of the joint are thereby greatly increased. Furthermore, the panels and cleats are rigidly interconnected through the joint structure and cannot yield to the stress imposed by thermal expansion and contraction of the sheet metal material.

A third type of lap joint structure for a sheet metal roofing assembly consists merely of overlapping panel edges riveted and soldered together. Although this is the strongest type of joint, it, too, suffers from several disadvantages. A simple overlap between panel edges does not accommodate the use of cleats to anchor the panel assembly to the roof substrate, whereby the panels must be anchored by means of nails or other fasteners perforating the panels. Nails not only present an unsightly appearance with frequent damage from hammer blows to the surrounding sheet metal material, but also cause imperfect perforations which are difficult to seal with solder, and their use may be prohibitively labor intensive on a large project. Sheet metal screws are likely to be used more commonly than nails since they may be quickly and easily inserted by means of an automatic driving tool. However, the drilling action of the automatic tool tends to shred the sheet metal material to raise a burr at each perforation which both disrupts the level contour of the panels and increases the difficulty of sealing the perforation with solder. Again, the rigidly anchored assembly cannot accommodate thermally induced movement of the panels.

Methods of constructing known joints for sheet metal roofing assemblies are correspondingly troublesome. Great difficulty is experienced in maintaining adjacent sheets in alignment with a planned layout.

The prior art is thus seen to fail to provide a joint structure for a sheet metal roofing assembly which can easily be soldered without a great deal of time and skill, which accommodates thermally induced movement of the sheet metal panels, and which can be securely anchored to the roof substrate without unsightly and leak-prone perforations through the panels.

SUMMARY OF THE INVENTION

The present invention overcomes the above-described disadvantages and others and provides a lap joint structure for a sheet metal roofing assembly which securely anchors the sheet metal panels to the roof substrate with provision for thermally induced movements of the panels and without leaks, as well as an efficient and simplified method of installing the joint structure.

In accordance with a principal feature of the invention, there is provided an elongated joint structure for a roofing assembly covering a roof substrate, the joint structure comprising cleat means extending longitudinally along the joint structure to define first and second transverse directions across the joint. The cleat means has cleat hook means and is rigidly anchored to the roof substrate. A first panel is provided with a first edge extending along the joint structure, a first major section extending from the first edge in the first transverse direction across the joint, and panel hook means associated with the first edge. The panel hook means is engaged with the cleat hook means to restrain the first panel from movement away from the cleat means in the first transverse direction across the joint. A second panel is provided with a cover section overlying the cleat hook means and engaged panel hook means, a second major section extending from the cover section in the second transverse direction from the joint, and an attachment section extending from the cover section in the first transverse direction. The attachment section of the second panel is rigidly attached to the first major section of the first panel. In this arrangement, the first and second panels are rigidly attached to one another and are securely anchored to the roof substrate through the cleat. In advantageous distinction to the prior art, the panels are not rigidly anchored to the roof substrate, either directly or through the cleat. A slight amount of clearance where the panel hook means engages the cleat hook means thereby permits a slight amount of transverse movement of the joined panels together across the cleat. The invention thus accommodates thermally induced strains in the roofing assembly.

In accordance with a more specific feature of the invention, a joint structure as defined above is provided wherein the attachment section of the second panel has a second edge overlying the first major section of the first panel, with those sections being soldered together. Only two layers of panel material must be heated to create conditions wherein the molten solder will be drawn inwardly between the panel sections being soldered. An additional specific feature in this respect is the provision of means for blocking the flow of liquid solder in the first transverse direction away from the second edge of the second panel in order to maintain control of the molten solder and to provide a neat finished appearance. The preferred means for blocking the flow of liquid solder away from the soldered edge is a raised rib in the first panel extending parallel to and closely spaced from the second edge of the second panel.

Further regarding soldering of the first and second panels, the panels may advantageously be composed of Terne Coated Stainless Steel, a product of Follansbee Steel Corporation, assignee of the present patent application. Terne Coated Stainless Steel bears a surface layer of solder material which melts appropriately upon heating to eliminate the necessity of externally applied solder and the labor and material costs associated therewith.

In accordance with another specific feature of the invention, in addition to the provision of solder to attach the panels and to seal the joint, pop rivets are provided to rigidly connect the major section of the first panel to the overlying attachment section of the second panel. Pop rivets will securely connect the panel sections without anchoring them to the roof substrate. As discussed above, the connected panels are anchored to the roof substrate through the cleat in a manner to permit thermally induced movement of the connected panels transversely across the joint and the substrate.

Yet another specific feature of the invention provides the cleat means in the form of an elongated sheet metal cleat extending longitudinally in the direction of the joint. This advantageously facilitates installation of the joint in a straight line without the need for precise and skillful alignment of a plurality of individual cleats spaced along the joint line.

In accordance with another principal feature of the invention, there is provided a method of constructing an elongated joint between panel components of a roofing assembly covering a roof substrate. The method comprises the steps of providing components including a first panel having panel hook means defining a longitudinal direction and first and second opposing transverse directions with respect to the joint when the first panel is in a first assembled position; a cleat adapted to be rigidly anchored to the roof substrate and having cleat hook means for engagement with the panel hook means to restrain the first panel from movement from the cleat in the first transverse direction; and a second panel having an attachment section. The first panel is placed in the first assembled position, the cleat hook means are engaged with the panel hook means, and the cleat is rigidly anchored to the roof substrate. The second panel is placed in a second assembled position overlying the cleat with the attachment section thereof overlying the first panel, and the attachment section is then rigidly attached to the first panel. This results in a joint which includes a rigid connection between the panels, a rigid anchored connection between the cleat and the roof substrate, and a secure attachment of the panels to the substrate through the cleat which is transversely shiftable across the joint and substrate in response to thermally induced stresses in the panel material.

In accordance with a specific feature of the method, the panels in the assembled positions are first releasably anchored to the roof substrate at a base anchoring point to hold the panels steady against longitudinal or transverse movement out of position. The panels are then more easily rigidly attached together in the proper alignment. The releasable anchoring step is preferred to comprise the specific steps of punching a hole into the substrate through the overlapping panel sections and inserting a releasable locator pin into the hole. A second hole may be punched to provide a supplemental releasable anchoring point, preferably at a position longitudinally spaced along the joint from the base anchoring point, for insertion of a supplemental releasable locator pin. This would restrain the panels from horizontal rotation about the locator pin in the base anchoring hole and would thereby more completely hold the panels in aligned positions. Rigid connection of the overlapped panel sections by means of pop rivets and sealing of the joint with solder would then follow with subsequent removal of the releasable locator pins and sealing of the respective locator holes with solder.

Specific features of the method pertain to the riveting step. Use of a punching tool to drive the holes in which the pop rivets are inserted provides an indentation in the sheet metal panels to effectively countersink the pop rivets and avoid a disruptive burr in the material as caused by prior art screw threading methods. Importantly, setting of the pop rivets in a countersunk manner contributes to pooling of the solder thereafter applied to seal the punctures.

The principal object of the present invention is to provide a lap joint structure for adjoining sheet metal roofing panels which can accommodate thermally induced expansion and contraction of the panels while securely anchoring the panels to the roof substrate along planned lines.

Another object of the invention is to provide a securely sealed joint structure for adjoining sheet metal roofing panels which can be efficiently and easily installed without a great deal of expertise.

A further object of the invention is to provide a method of constructing a joint between adjoining sheet metal roofing panels which is more effective and less skillfully demanding than prior methods.

Yet another object of the present invention is to provide a lap joint for a sheet metal roofing assembly and a method of constructing the joint which enables the use of the elongated adjacent panels extending in planned lines from the eave to the ridge of the roof assembly.

These and other objects of the invention will become apparent from the following description of a preferred embodiment thereof taken together with the accompanying drawings.

BRIEF DESCRIPTION OF THE DRAWINGS

FIG. 5 is a partial cross sectional view of a sheet metal panel in accordance with the invention;

FIG. 6 is a cross sectional view of a prior art joint structure;

FIG. 7 is a cross sectional view of another prior art joint structure; and,

DESCRIPTION OF THE PREFERRED EMBODIMENT

Figure 1:
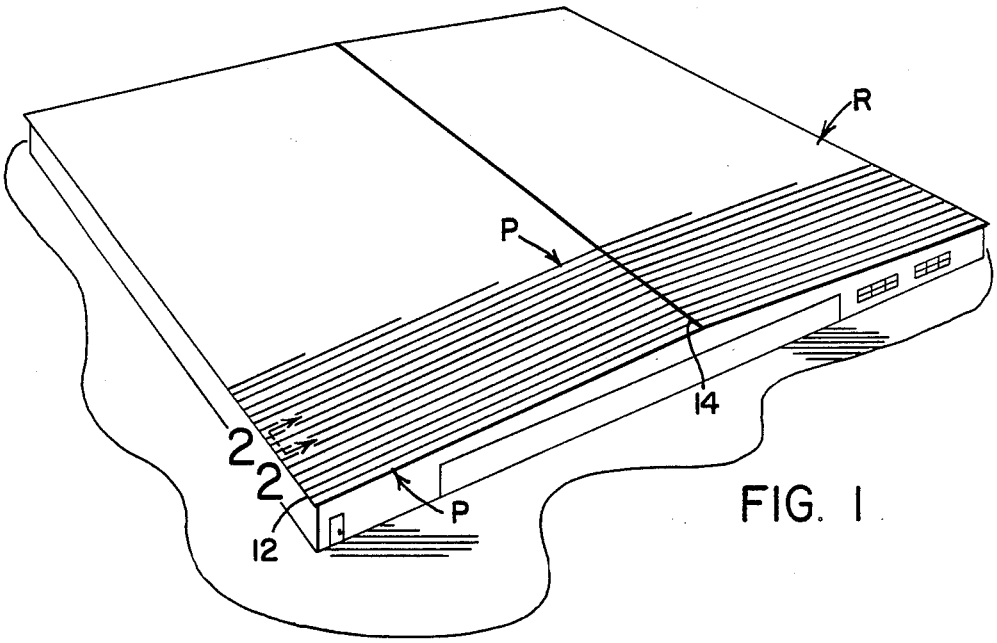
FIG. 1 is a pictorial view of a building having a roof assembly including a joint structure in accordance with the invention.
Figure 2:
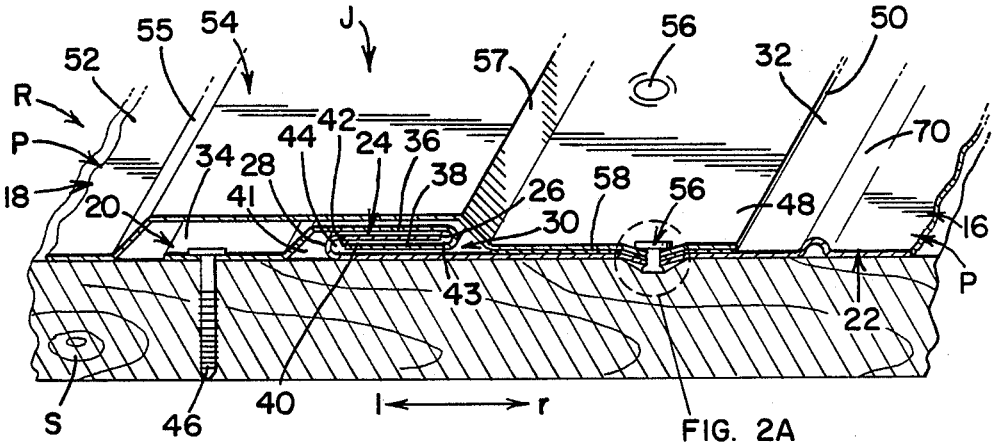
FIG. 2 is a cross sectional view of a joint structure in accordance with the invention taken on line 2—2 of FIG. 1.

Referring now to the drawings wherein the showings are for the purpose of illustrating a preferred embodiment of the invention and not for the purpose of limiting the invention, in FIGS. 1 and 2 there is shown a roof assembly R covering a wooden roof substrate S and including a joint structure J in accordance with the invention. The roof assembly R comprises adjacent elongated panels P extending from the eave 12 to the ridge 14, with an adjacent pair of panels, such as panels 16 and 18 shown in FIG. 2, being joined by the joint structure J. The joint structure J is likewise elongated to extend longitudinally between the joined panels 16 and 18 and to define transverse right and left hand directions r and 1 thereacross. More specifically, the joint structure J comprises a right hand or first panel 16, a left hand or second panel 18, and a cleat 20.

The first panel 16 includes a major portion 22 and a hook or hem section 24. The hem section 24 includes a first free edge 26 and is folded back over the major portion 22 to define a folded terminal edge 28 and an open hem pocket 30. A first attachment section 32 of the major portion 22 is defined adjacent the open hem pocket 30.

The cleat 20 is preferred to comprise an elongated component extending longitudinally in the direction of the joint structure J and is formed into substantially parallel sections including a base section 34, an intermediate section 36, and a hook section 38 arranged with respect to the intermediate section 36 to define an open cleat pocket 40. A cleat space 41 is defined between the free edge 42 of the hook section 38 and the base section 34 as shown in FIG. 2. The cleat 20 takes an assembled position with the hook section 38 received within the open hem pocket 30 of the first panel 16, and with the hem section 24 of the first panel 16 likewise received within the open cleat pocket 40 as shown in FIG. 2. The first panel 16 is thereby restrained from movement away from the cleat 20 in the right hand direction r. Slight clearance spaces 43 and 44 are preferably provided between the innermost ends of the open pockets 30 and 40 and the free edges 42 and 26 of the sections 38 and 24 respectively received therein. The base section 34 of the cleat 20 is rigidly anchored to the substrate S by means of nails 46.

The second panel 18 comprises a second attachment section 48 overlying the first attachment section 32 of the first panel 16 and including a second free edge 50; a second major portion 52 generally co-planer with the second attachment section 48 and extending from the joint structure S in the left hand direction 1 atop the roof substrate S; and a cover section 54 extending between the second attachment section 48 and the second major portion 52 out of the plane of those components to overlie the cleat 20 and the hem section 24 of the first panel 16. Angularly disposed transition portions 55 and 57 of the cover section 54 provide strength. A rigid attachment between the second attachment section 48 of the second panel 18 and the first attachment section 32 of the first panel 16 is made by means of pop rivets 56 and solder 58.

Figure 3:
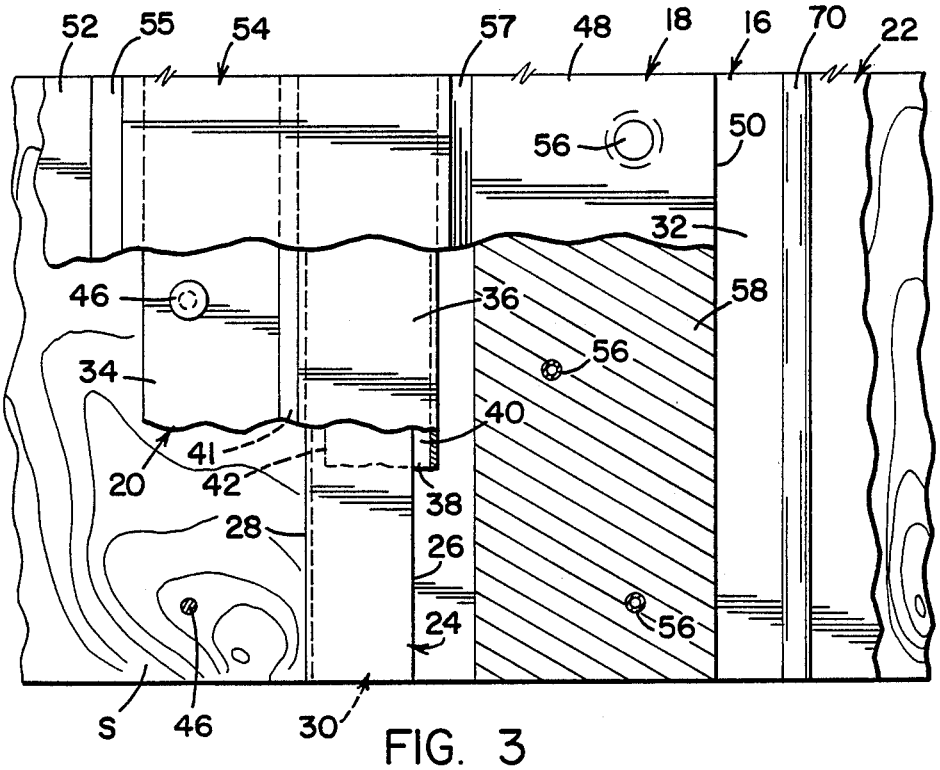
FIG. 3 is a partial top plan view, partially cut away, of the joint structure shown in FIG. 2.

It is to be understood that the elongated panels P typically have a left hand sided formed as the left hand side of the first panel 16 shown in FIGS. 2 and 3, and an opposite right hand side formed as the right hand side of the second panel 18 as shown in order to provide successive joint structures J between successive adjacent panels P. Furthermore, one longitudinal end of a panel P may have a narrower width than the other end to fit into a curved roof structure.

The joint structure J as thusfar defined securely anchors the roof assembly R to the substrate S yet fully accommodates thermally induced strains in any direction across the roof assembly R. This feature of the invention is provided by the novel arrangement wherein the two joined panels 16 and 18 are rigidly connected only to one another and not to the cleat 20 or the underlying substrate S. In contrast to the prior art lap joint structure known as a flat lock joint with cleats as shown in FIG. 6 to have a rigid soldered connection between the joined panels and the cleats, the joint structure J in accordance with the present invention, enables the joined panels 16 and 18 to shift together in the right and left hand directions r and l as permitted by the clearance spaces 43 and 44 and the cleat space 41. Movement in the longitudinal direction of the joint structure S is also permitted as needed by the arrangement where the hem pocket 30 and the cleat pocket 40 are open with respect to the sections 38 and 24 respectively received therein. The same structural advantages of the present invention are obtained over the prior art lap joint structure shown in FIG. 7 which also has a rigid connection between the joined panels and the underlying substrate.

A method of constructing the joint structure J is also provided in accordance with the present invention. The cleat 20 is placed in the assembled position described above with the hook section 38 received within the hem pocket 30 of the first panel 16, and the base section 34 of the cleat 20 is then rigidly anchored to the substrate S by means of nails 46 or other suitable rigid fasteners such as screws or the like. Use of an elongated cleat 20, preferably co-extensive with the elongated joint structure J, as opposed to a row of spaced cleats as indicated in FIG. 6 greatly simplifies this initial step in the construction process. The second panel 18 is then placed in position with the second attachment section 48 overlapping the first attachment section 32 of the first panel 16 as shown in FIG. 2 such that the cover section 54 overlies the cleat 20 and the engaged hem section 24. A rigid connection between the panels 16 and 18 is then made in accordance with the sequence of steps illustrated in FIGS. 4A through 4F.

Figure 4A:
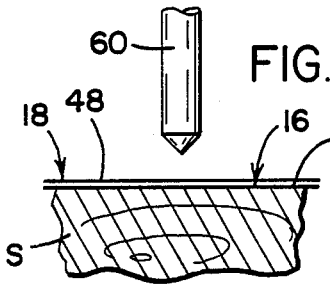
FIGS. 4A–4F are cross sectional views showing a sequence of steps taken in the method of constructing a joint structure in accordance with the invention.
Figure 4B:
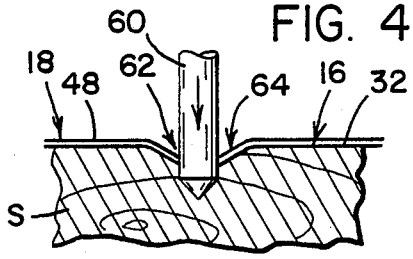
Figure 4C:
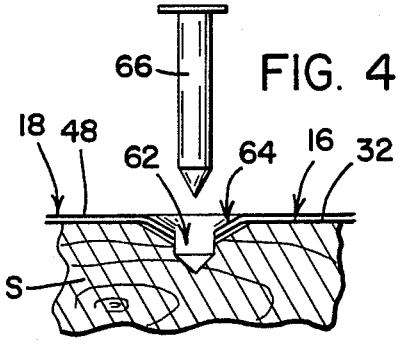
Figure 4D:
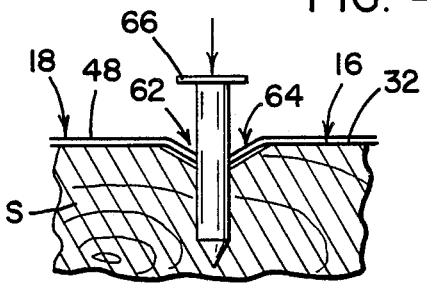

In FIGS. 4A and 4B a punching tool 60 is shown to drive a hole 62 into the substrate S through the first and second attachment sections 32 and 48 of the first and second panels 16 and 18 with the effect of producing a slight depression 64 in those sections of the panels about the hole 62. In FIGS. 4C and 4D a locator pin 66 is shown to be loosely inserted into the hole 62 as a temporary anchor for the panels 16 and 18 in order to hold them in their assembled positions before a permanent rigid connection is made therebetween. One or more of these anchoring arrangements may be made as required since a single temporary anchor will restrain the panels 16 and 18 from lateral movements across the joint structure J, but a second anchor spaced longitudinally from the first may be required to restrain the panels from rotation about the first anchor. Placement of a releasable anchor at each opposite end of the elongated joint structure J, when the panels are placed in proper alignment, would thus be an efficient means of holding the panels in line. With the panels 16 and 18 thus releasably held in line, a plurality of pop rivets 56 are installed in a generally staggered array along the longitudinal extent of the overlapping attachment sections 32 and 48 as shown in FIGS. 2 and 3.

Figure 2A:
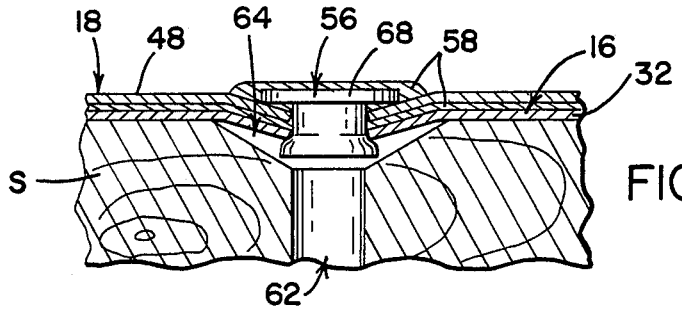
FIG. 2A is an enlarged partial view of the joint structure shown in FIG. 2.
Figure 4E:
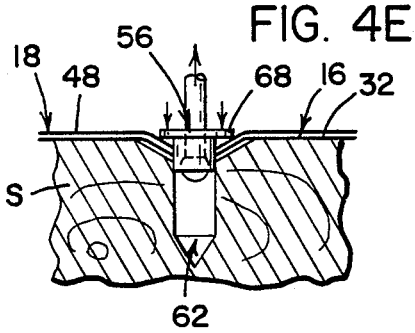
Figure 4F:
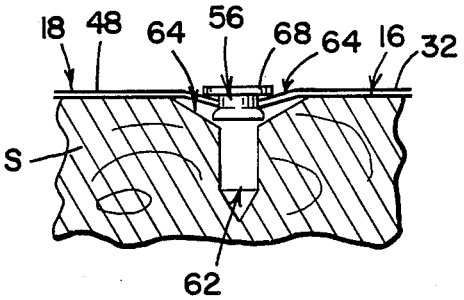

An important feature of the invention arises in the use of pop rivets as illustrated in FIGS. 4E and 4F wherein it is shown that the depression 64 caused by use of the driving tool 60 enables the heads 68 of the pop rivets 56 to rest in a somewhat countersunk position with respect to the overlapping panel sections 32 and 48. In the case of a wooden substrate S as shown in FIGS. 4F and 2A, or another substrate which would similarly yield under the impact force of the driving tool 60, the depression 64 would further provide clearance between the substrate and the panel sections for expansion of the rivet shaft into the position wherein it holds the two Joined panel sections together. These particular steps of the present method provide a distinct advantage over prior art methods using sheet metal screws which tend to raise a burr beneath the overlapping panel sections to disrupt the level contour of the completed roof assembly, and which do not countersink the screw heads to provide a relatively smooth surface.

Following installation of the pop rivets as described above, the overlapping panel sections 32 and 48 are sealed together with solder. The present invention also provides several advantages over the prior art in the soldering step. In distinction to the prior art configuration shown in FIG. 6 wherein six overlapping layers of sheet metal material must be thoroughly heated by a soldering iron in order to create conditions required for a thorough application of molten solder, only the two overlapping attachment sections 32 and 48 of the first and second panels 16 and 18 need to be heated in accordance with the present invention. This not only reduces the operator skill, time, and consequent cost of the soldering operation, but also greatly reduces the risk that an incomplete seal will be made. As shown in FIG. 2A, a spot of solder may be provided atop each rivet head 68 in order to provide a thoroughly complete seal as well as a smooth finished appearance.

Another beneficial feature of the invention is the provision of means for containing the molten solder at a region closely adjacent the second free edge 50 of the second panel 18 where it overlaps the first panel 16. This means is preferred to take the form of a raised rib 70 extending along the major portion 22 of the first panel 16 parallel to and closely spaced from the second free edge 50 as shown in FIGS. 2 and 3. The raised rib 70 acts as a dam for containment of molten solder which might otherwise flow outwardly from the second free edge 50 onto the major portion 22 of the first panel 16.

An additional feature of the invention regarding soldering is the use of Terne Coated Stainless Steel, a product of Follansbee Steel Corp. Terne Coated Stainless Steel is pretinned to bear a surface coating of solder material 72 as shown in FIG. 5. Use of Terne Coated Stainless Steel insures complete application of molten solder between the overlapping panel sections as shown in FIG. 3. In accordance with the present invention, the sheet metal panels may bear a partial surface coating of solder material 74 or a complete surface coating of solder material 72 as shown in FIG. 5.

Figure 8:
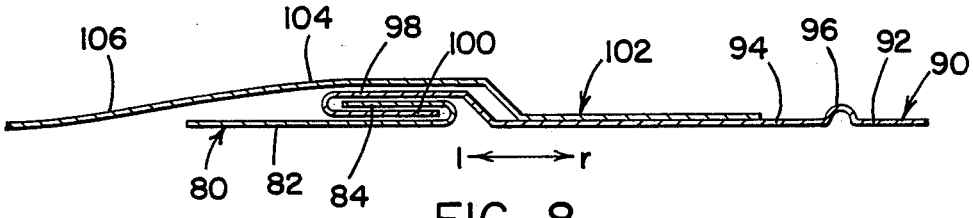
FIG. 8 is a cross sectional view of an alternate embodiment of a joint structure in accordance with the present invention.

The invention has been described with reference to the preferred embodiment. It will be appreciated that modifications or alterations which would not deviate from the present invention will occur to others upon their reading and understanding of this specification. For example, in FIG. 8 there is shown an alternate joint structure J including an alternate cleat 80 and an alternate first panel 90. The alternate cleat 80 comprises a base section 82 and a hook section 84 folded back over the base section 82 in the left hand direction l as shown. The alternate first panel 90 includes a major portion 92 with an attachment section 94 and a raised rib 96; an intermediate section 98 spaced above the plane of the attachment section 94 and extending tberefrom in the left hand direction l, and a hem section 100 folded back beneath the intermediate section 98 to define a hem pocket open to the right hand direction r as shown. This arrangement enables placement and anchoring of the alternate cleat 80 to the substrate S before placement of the alternate first panel 90 in its assembled position with respect to the cleat 80, whereby all of the cleats may first be installed along established lines to thereafter avoid precise attention to alignment upon installation of each of the panels to be engaged therewith. Also, an alternate second panel 102 is shown in FIG. 8 to have a cover section 104 and a generally distinct major portion 106 which is permitted to descend to the level of the substrate S from the cover section 104 without a sharp transition section on that side. In this respect, both transition sections 55 and 57 of the cover section 54 described above could be omitted but are employed in the preferred embodiment to impart strength to the cover section and to insure overlapping contact of the adjacent attachment section over the first panel. It is intended that all such modifications and alternate arrangements be included insofar as they come within the scope of the dependent claims or the equivalence thereof.

Having thus described the invention, it is claimed:

1. An elongated joint structure for a roofing assembly covering a roof substrate, said joint structure comprising:

cleat means extending longitudinally along said joint structure to define a first and second transverse directions across said joint structure, said cleat means having cleat hook means and being rigidly anchored to said substrate;

a first panel having a first edge extending along said joint structure, a first major section extending from said first edge in said first direction, a panel hook means associated with said first edge, said panel hook means being engaged with said cleat hook means to restrain said first panel from movement from said cleat means in said first direction; and, a second panel having a cover section overlaying said cleat hook means and said engaged panel hook means, a second major portion extending from said cover section in said second direction, and an attachment section extending from said cover section in said first direction, said attachment section being rigidly attached to said first major portion of said first panel.

2. An elongated joint structure as defined in claim 1 wherein said attachment section of said second panel has a second edge overlaying said first major portion; and further including solder between said attachment section and said first major section adjacent to said second edge.

3. An elongated joint structure as defined in claim 2 wherein said first major portion includes means for blocking the flow of liquid solder in said first direction from said second edge.

4. An elongated joint structure as defined in claim 3 wherein said blocking means comprises a raised rib parallel to and closely spaced from said second edge.

5. An elongated joint structure as defined in claim 4 further including pop rivets connecting said attachment section to said first major portion.

6. An elongated joint structure as defined in claim 1 wherein said first major portion of said first panel and said attachment section of said second panel are comprised of sheet metal, and at least one of said sections bears a surface layer of solder material.

7. An elongated joint structure as defined in claim 1 wherein said joint structure has a first and a second end, with said first end being disposed on said roof substrate at a position vertically below said second end.

8. An elongated joint structure as defined in claim 6 wherein said joint structure has a first and a second end, with said first end being disposed on said roof substrate at a position vertically below said second end.

9. A roofing assembly comprising:

a first rigid sheet having a major portion and a hem section, said hem section being folded over said major portion to define a first free edge of said first sheet, a folded terminal edge of said first sheet, and a hem pocket open along said first free edge, said major portion including a first attachment section adjacent said hem pocket;

a rigid cleat comprising a planer base section, a planer hook section with a hook end, and a planer intermediate section between said base and hook sections, said hook end being receivable in said open end of said hem pocket to define a hooked position of said cleat with said intermediate section overlaying said hem section and with said base section extending from said folded terminal end;

a second rigid sheet having a second free edge, a second attachment section including said second free edge, and a cover section adjacent said second attachment section, said second attachment section being adapted to register with said first attachment section with said cover section overlaying said hem section and said intermediate section of said cleat when said cleat is received in said hooked position; and, means for rigidly attaching said first attachment section to said second attachment section.

10. A roofing assembly as defined in claim 9 wherein said first attachment section comprises a first flat planer surface adjacent said hem section; and said second attachment section comprises a second flat planer surface to register in facial contact with said first flat plainer surface.

11. A roofing assembly as defined in claim 10 wherein said first flat planer surface, said hem section, and said intermediate section of said cleat are generally parallel when said cleat is received in said hooked position.

12. A roofing assembly as defined in claim 11 wherein said attachment means comprises pop rivets and solder material.

13. A roofing assembly as defined in claim 12 wherein said major portion of said first sheet includes a raised rib generally parallel to said first free edge to define said first flat planer surface between said rib and said first free edge; and said second free edge is adapted to overlay said first flat planer surface at a position closely adjacent said rib.

14. A roofing assembly as defined in claim 9 wherein second sheet further includes a body section adjacent said cover section and generally co-planer with said second attachment section; with said cover section extending between said body and attachment sections out of the plane of said sections.

15. A roofing assembly as define in claim 13 wherein said second sheet further includes a body section adjacent said cover section and generally co-planer with said second attachment section; with said cover section extending between said body and attachment sections out of the plane of said sections.

16. A roofing assembly as defined in claim 9 wherein said sheets are comprised of sheet metal and at least one of said sheets bears a surface layer of solder material.

17. A roofing assembly as defined in claim 13 wherein said sheets are comprised of sheet metal and at least one of said sheets bears a surface layer of solder material.

18. A roofing assembly as defined in claim 15 wherein said sheets are comprised of sheet metal and at least one of said sheets bears a surface layer of solder material.

19. A roof cover structure for placement on a roof surface and comprising:

a first rigid sheet having a major portion and a hem section, said hem section having a first free edge and being folded over said major portion into a position generally parallel to said roof surface to define a folded terminal edge of said first sheet and a hem pocket open along said first free edge, said major portion including a substantially flat planer first attachment section adjacent said hem pocket;

a rigid cleat comprising a planer hook section with a hook end, a planer intermediate section adjacent said hook section, and a planer base section adjacent said intermediate section, with said hook end extending into said open end of said hem pocket, said intermediate section overlaying and generally parallel to said hem section of said first sheet, and said base section securely anchored to said roof surface; and, a second rigid sheet having a cover section, a second free edge, and a substantially flat planer second attachment section between said cover section and said second free edge, with said cover section overlaying said hem section and said intermediate section, and with said second attachment section overlapping and rigidly attached to said first attachment section.

20. A roof cover structure as defined in claim 19 wherein said first and second attachment sections, said hem section, and said intermediate section are generally parallel.

21. A roof cover structure as defined in claim 20 wherein said hook end is substantially co-extensive with said folded terminal end of said first sheet.

22. A roof cover structure as defined in claim 20 further including pop rivets attaching said first attachment section to said second attachment section, and solder material between said sections.

23. A roof cover structure as defined in claim 22 wherein said major portion of said first sheet includes a raised rib generally parallel to said first free edge to define said first attachment section between said rib and said first free edge; and said second free edge extends over said first attachment section at a position closely adjacent said rib.

24. A roof cover structure as defined in claim 23 wherein said solder material extends across said first attachment section from a position between said attachment sections to a position in contact with said rib.

25. A roof cover structure as defined in claim 19 wherein said second sheet further includes a body section adjacent said cover section and generally co-planer with said second attachment section; with said cover section extending between said body section and said second attachment section out of the plane of said sections.

26. A roof cover structure as defined in claim 20 wherein said second sheet further includes a body section adjacent said cover section and generally co-planer with said second attachment section; with said cover section extending between said body section and said second attachment section out of the plane of said sections.

27. A roof cover structure as defined in claim 23 wherein said second sheet further includes a body section adjacent said cover section and generally co-planer with said second attachment section; with said cover section extending between said body section and said second attachment section out of the plane of said sections.

28. A roof cover structure as defined in claim 19 wherein said sheets are comprised of sheet metal and at least one of said sheets bears a surface layer of solder material at the attachment section thereof.

29. A roof cover structure as defined in claim 20 wherein said sheets are comprised of sheet metal and at least one of said sheets bears a surface layer of solder material at the attachment section thereof.

30. A roof cover structure as defined in claim 23 wherein said sheets are comprised of sheet metal and at least one of said sheets bears a surface layer of solder material at the attachment section thereof.

31. A method of constructing an elongated joint between panel components of a roofing assembly covering a roof substrate, said method comprising the steps of:

(a) providing a first panel having panel hook means defining a longitudinal direction and first and second opposing transverse directions with respect to said elongated joint when said first panel is in a first assembled position;

(b) providing a cleat adapted to be rigidly anchored to said roof substrate and having cleat hook means for engagement with said panel hook means to restrain said first panel from movement from said cleat in said first transverse direction;

(c) providing a second panel having an attachment section;

(d) placing said first panel in said first assembled position;

(e) engaging said cleat hook means with said panel hook means;

(f) rigidly anchoring said cleat to said roof substrate;

(g) placing said second panel in a second assembled position overlaying said cleat with said attachment section overlaying said first panel;

(h) releasably anchoring said first and second panels to said roof substrate at a base anchoring point to prevent movement of said panels in said longitudinal or transverse directions at said anchoring point; and, (i) rigidly connecting said attachment to section of said second panel to said first panel.

32. A method as defined in claim 31 wherein said releasable anchoring step comprises the steps of punching a hole into said substrate through said overlaying attachment section of said second panel and said first panel, and inserting a releasable locator pin into said hole.

33. A method as defined in claim 32 wherein said connecting said comprises placement of pop rivets connecting said attachment section of said second panel to said first panel at longitudinally spaced locations along said overlaying attachment section.

34. A method as defined in claim 33 wherein said connecting step further comprises soldering said attachment section of said second panel to said first panel.

35. A method as defined in claim 34 further including the step of:

(j) removing said releasable locator pin following said connecting step.

36. A method as defined in claim 35 further including the step of:

(k) sealing said hole with solder.

37. A method as defined in claim 32 further including the step of:

(j) further releasably anchoring said first and second panels to said roof substrate at a second anchoring point spaced longitudinally along said joint from said base anchoring point to restrain rotational movement of said panels about said base anchoring point, said further anchoring step comprising punching a second hole into said substrate through said first panel and said overlaying attachment section of said second panel, and inserting a second releasable locator pin into said second hole.

38. A method as defined in claim 34 further including the step of:

(j) further releasably anchoring said first and second panels to said roof substrate at a second anchoring point spaced longitudinally along said joint from said base anchoring point to restrain rotational movement of said panels without said base anchoring point, said further anchoring step comprising punching a second hole into said substrate through said first panel and said overlaying attachment section of said second panel, and inserting a second releasable locator pin into said second hole.

39. A method as defined in claim 38 further including the step of:

(k) removing said releasable locator pins following said connecting step and sealing said holes with solder.

40. A method as defined in claim 31 further including the step of:

(j) providing at least one of said first and second panels with a surface layer of solid solder material.

41. A method as defined in claim 34 further including the step of:

(j) providing at least one of said first and second panels with a surface layer of solid solder material.

42. A method as defined in claim 31 wherein said step of rigidly anchoring said cleat to said roof substrate precedes said step of engaging said cleat hook means with said panel hook means.

* * * * *